United States Patent [19]

Gutgsell

[11] Patent Number: 4,838,180

[45] Date of Patent: Jun. 13, 1989

[54] FOLDING TABLE LEG APPARATUS

[75] Inventor: David R. Gutgsell, Japser, Ind.

[73] Assignee: Ditto Sales, Inc., Jasper, Ind.

[21] Appl. No.: 163,896

[22] Filed: Mar. 4, 1988

[51] Int. Cl.[4] ..... A47B 3/00

[52] U.S. Cl. ..... 108/132; 248/439; 248/188.6; 108/150

[58] Field of Search ..... 108/132, 133, 131, 129, 108/130, 150; 298/188, 188.1, 188.6, 371, 284, 286, 439, 166

[56] References Cited

U.S. PATENT DOCUMENTS

| | | | |
|---|---|---|---|
| 2,022,399 | 11/1935 | Beiger | 248/188.6 X |
| 2,075,778 | 3/1937 | Johannsen . | |
| 2,355,929 | 8/1944 | Tave | 248/188.6 |
| 2,694,827 | 11/1954 | De Saussure, Jr. | 108/133 |
| 2,977,169 | 3/1961 | Geller | 108/129 X |
| 3,327,656 | 6/1967 | Schwartz | 248/371 X |
| 3,635,172 | 1/1972 | De Saussure et al. | 108/132 X |
| 3,695,567 | 10/1972 | Weagle | 108/132 X |
| 3,818,844 | 6/1974 | Burr . | |
| 3,993,004 | 11/1976 | Alme | 108/150 X |
| 4,079,679 | 3/1978 | Bechtold | 108/132 |
| 4,444,124 | 4/1984 | Burr | 108/132 X |
| 4,444,125 | 4/1984 | Welsch et al. | 248/188 X |
| 4,561,622 | 12/1985 | Heinzel | 108/131 X |
| 4,658,735 | 4/1987 | Holton | 108/132 X |

FOREIGN PATENT DOCUMENTS

| | | | |
|---|---|---|---|
| 793717 | 9/1968 | Canada | 108/129 |

OTHER PUBLICATIONS

Copy of advertisement from May 1986 issue of "Contract" Magazine for a Folding Table Base Manufactured by CHF Industries.

*Primary Examiner*—Kenneth J. Dorner
*Assistant Examiner*—José V. Chen
*Attorney, Agent, or Firm*—Woodard, Emhardt, Naughton, Moriarty & McNett

[57] ABSTRACT

A folding table includes a tabletop and a number of legs operable between a folded and an extended position. A folding table leg apparatus associated with each of the legs comprises a top plate mounted to the tabletop, the top plate having a pair of side flanges. Each of the side flanges has a height greater than the effective diameter of one leg. The flanges and the top plate define an envelope within which the leg is contained in its folded position and the folding apparatus itself is fully contained within the envelope when the leg is in its folded position. The folding table leg apparatus includes a pair of brace links straddling the leg, each of the pair of brake links being pivotably mounted at a first end to the top plate and pivotably connected at a second end to diametrically opposite portions of the leg, such that the brace links provide support for the leg in its extended position. A pair of swivel brackets straddling the leg are pivotably mounted at a first end to the side flanges and are pivotably connected at a second end to diametrically opposite portions of the leg adjacent the top of the leg, by way of a first pivot rod extending through the leg. A support surface is associated with the top plate for vertically supporting the first pivot rod when the leg is in its extended position. The folding table leg apparatus also includes a pair of independent lever arms straddling the leg and pivotably mounted to the top plate for releasably engaging and urging the first pivot rod into the support surface when the leg is in its extended position.

13 Claims, 3 Drawing Sheets

FOLDING TABLE LEG APPARATUS

BACKGROUND OF THE INVENTION

This invention broadly pertains to folding furniture, and more particularly to tables having legs that fold compactly underneath the tabletop.

Folding tables are widely used and derive their primary benefit from the relative ease with which they can be handled and stored when in the folded condition. A typical folding table leg is described in the patent to Weagle, U.S. Pat. No. 3,695,567. Folding tables of this type do not include a cross brace that provides fore and aft support for the table leg. Another difficulty with folding table designs such as Weagle, is that the folded legs do not provide a uniform surface on which other folded tables may be stacked. Examples of a folding trestle-type table are given in the patents to Burr, U.S. Pat. Nos. 3,818,844 and 4,444,124. In these tables, the vertical legs do not overlap each other; however, like the Weagle device, the folded legs double as a stacking surface for other folded tables. Moreover, with the trestle design of these tables, it is difficult to fold the table legs into the tabletop.

The folding tables described in the patents to Johannsen, U.S. Pat. No. 2,075,778 and Holton, U.S. Pat. No. 4,658,735, each include a support brace that is pivotably mounted to a frame connected to the underside of the tabletop. In each of these devices, a guide pivot link is pivotably mounted between the frame and top of the vertical table leg to pull the top of the vertical table leg outward when the leg is moved to its folded orientation. With both of these folding table designs, other tables must be stacked on the table legs rather than a separate support surface. Moreover, each of these devices includes a notch in the support frame into which the guide pivot links engage when the leg is in the open position. Thus, in order to fold the legs, it is first necessary to pull the leg outward in order to disengage the guide pivot from the notch, which makes the operation of these folding table legs more cumbersome. In the HOlton device, the vertical table leg is folded on top of the support brace, which increases the folded thickness of the table. Finally, other than the notch in the support frame, neither of these patents discloses a positive locking feature to hold the vertical table leg in its open position and to prevent the leg from being accidentally folded.

The patent to De Saussure, et al., U.S. Pat. No. 3,635,172, discloses one method for holding the vertical table leg in its open position. This device includes a leaf spring that presses against a guide pivot link to hold the leg in position. A hand lever is included to provide a mechanical advantage to disengage the guide pivot link from a retaining notch.

With the disadvantages and limitations of the prior art folding table legs in mind, it is one object of the present invention to provide a mechanically simple, yet efficient, folding table leg apparatus. It is another object to provide a device that allows the table legs to be compactly folded while providing a uniform surface on which other tables may be stacked. Still another object is found in an apparatus that is readily adapted for use on a wide variety of tables of several lengths and styles.

Another object of the present invention is to define a folding table leg device that includes a positive locking feature that is not susceptible to accidental release. Yet another object is to provide a device that includes a firmly supported table leg, which support does not diminish due to wear and tolerance variations within the working components of the device. Other benefits and objects of the present invention will be apparent from the following description and accompanying figures.

SUMMARY OF THE INVENTION

A folding table includes a tabletop and a number of legs operable between a folded and an extended position. A folding table leg apparatus associated with each of the legs comprises a top plate mounted to the tabletop, the top plate having a pair of side flanges. Each of the side flanges has a height greater than the effective diameter of one leg. The flanges and the top plate define an envelope within which the leg is contained in its folded position and the folding apparatus itself is fully contained within the envelope when the leg is in its folded position. The folding table leg apparatus includes a pair of brace links straddling the leg, each of the pair of brace links being pivotably mounted at a first end to the top plate and pivotably connected at a second end to diametrically opposite portions of the leg, such that the brace links provide support for the leg in its extended position. A pair of swivel brackets straddling the leg are pivotably mounted at a first end to the side flanges and are pivotably connected at a second end to diametrically opposite portions of the leg adjacent the top of the leg, by way of a first pivot rod extending through the leg. A support surface is associated with the top plate for vertically supporting the first pivot rod when the leg is in its extended position. The folding table leg apparatus also includes a pair of independent lever arms straddling the leg and pivotably mounted to the top plate for releasably engaging and urging the first pivot rod into the support surface when the leg is in its extended position.

DESCRIPTION OF THE PREFERRED EMBODIMENT

Figure 1:
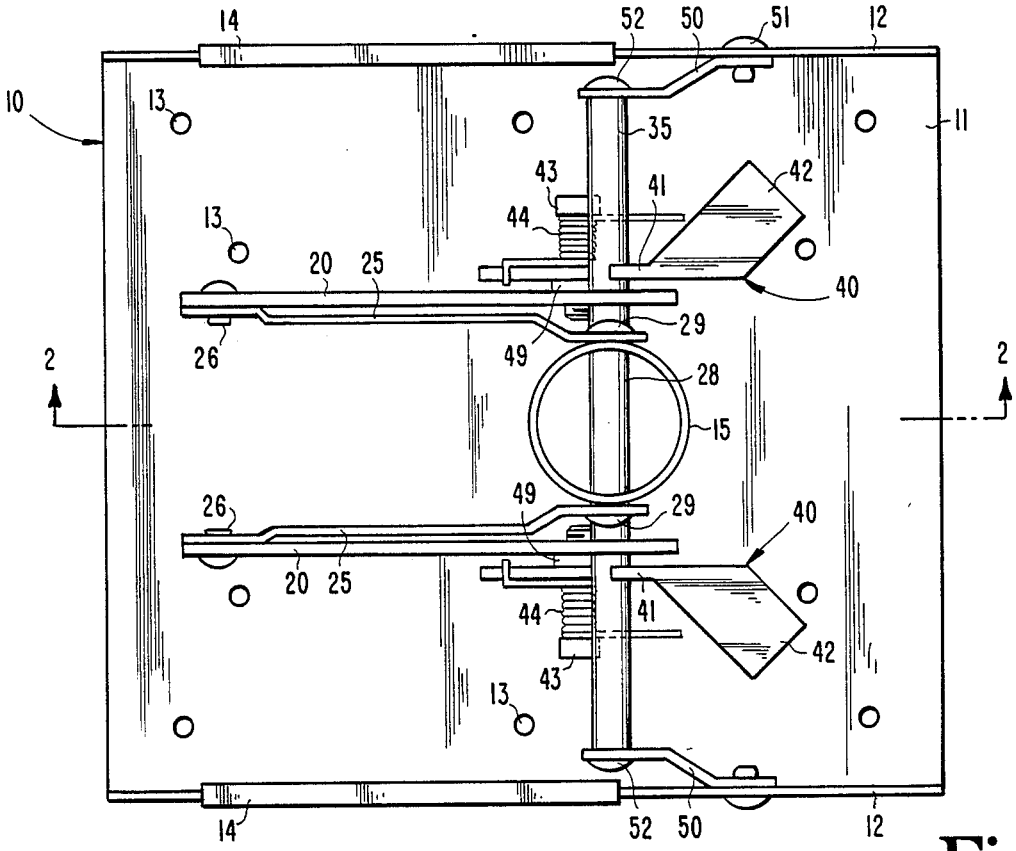
FIG. 1 illustrates in a top elevational view, the preferred embodiment of a folding table leg apparatus of the present invention, shown with the table leg in the extended position.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
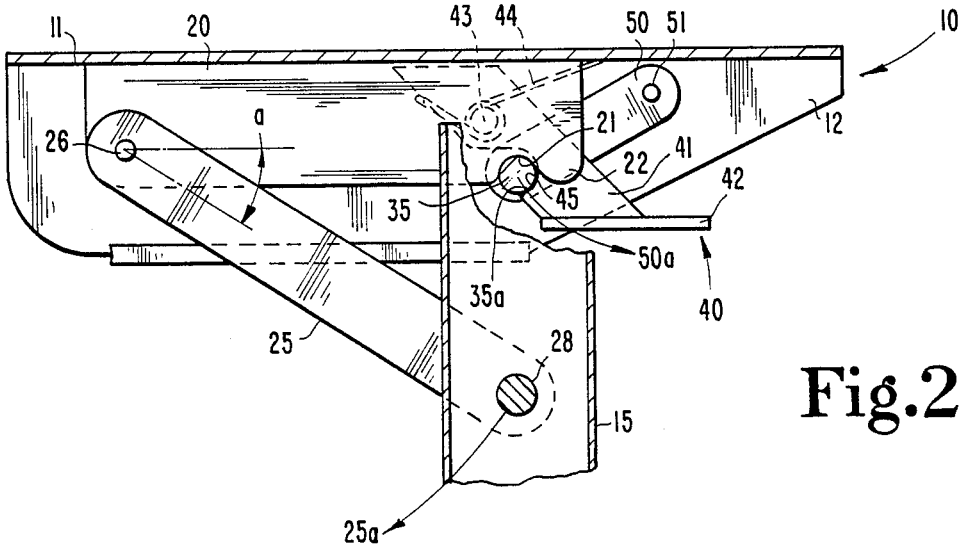
FIG. 2 is a cross-sectional view of the folding table leg apparatus shown in FIG. 1, taken along the line 2—2 as viewed in the direction of the arrows.

A folding table leg apparatus 10 of the preferred embodiment includes a top plate 11 that is bent upward at its edges to form side flanges 12, as shown in FIGS. 1 and 2. The folding table leg apparatus includes a plurality of mounting holes 13 through the top plate 11 so that the top plate can be affixed to the underside of a tabletop, not shown in the figures, by a suitable means, such as a wood screw. The folding table leg apparatus includes a vertical leg 15 that extends vertically downward and perpendicular to the top plate 11 when the leg is in the extended configuration shown in FIGS. 1 and 2. In the preferred embodiment, the vertical leg 15 is a hollow cylindrical post. However, the present invention is not limited to legs of this type, so that solid or hollow legs of various cross sections may be used with the folding table leg apparatus 10.

A pair of support brackets 20 are perpendicularly mounted to the underside of top plate 11, by suitable means, such as by welding. The support brackets 20 are laterally spaced apart a distance sufficient to accommodate the particular configuration of the vertical leg 15 therebetween, along with the associated folding apparatus to be described herein. The vertical leg 15 is connected to the support brackets 20 by a pair of brace links 25. The brace links 25 are pivotably mounted to the respective support brackets 20 by pivot rivet 26. The brace links 25 are associated at their distal end to the vertical leg 15 by a lower pivot rod 28 that pivots within a bore extending diametrically through the vertical leg 15. The brace links 25 are affixed to the lower pivot rod 28 by a pair of cap screws 29.

The lower pivot rod 28 is situated sufficiently far down from the top of the vertical leg 15 so that the brace links 25 are oriented at a support angle A relative to the top plate 11, as shown in FIG. 2, when the vertical leg is in its extended position. The brace links 25 thus provide adequate fore-aft support for the vertical leg in its extended position to prevent the leg from buckling. The use of the pair of brace links 25 also insures that the bracing support for the vertical leg 15 will be uniform on either side of the leg. In addition, because the brace links 25 are essentially straddling the vertical leg 15, the leg can be rotated between the two brace links 25 when the folding table leg apparatus is moved to its folded position for storage. This feature means that the apparatus 10 presents a thinner stored table than has been previously encountered with tables having but a single support strut.

In the extended position, the vertical leg 15 relies upon upper pivot rod 35 to provide the vertical restraint for the leg. Pivot rod 35 extends through a bore in the vertical leg 15 adjacent the top of the leg. The upper pivot rod 35 extends across the top plate 11 with its ends being directly adjacent the two side flanges 12. When the vertical leg 15 is in its extended position, upper pivot rod 35 rests against a support surface in the support bracket 20, in the present embodiment formed by notch 21. Thus, a vertical force exerted on vertical leg 15 produces a component at the upper pivot rod 35 acting against notch 21, and a vector component acting on brace link 25 through pivot rivet 26 into the support bracket 20. The support bracket 20 includes an ear 22 immediately adjacent the notch 21. Unlike the notches described in the prior art that provide fore-aft restraint for the table leg, the upper pivot rod 35 does not react against the ear 22 at all. The ear 22 exists simply as a manufacturing expedient, rather than as a support element. The ear 22 could be completely eliminated from the support bracket 20, leaving simply a flat surface extending from notch 21 to the end of the support bracket.

Fore and aft restraint for the upper pivot rod 35 is provided by release bracket 40. The release bracket 40 includes a lever arm 41 that is pivotably mounted at one end to the support bracket 20 by a pivot pin 43 extending through a shoulder bushing 49. At the other end of the lever arm 41 is an actuator plate 42 that can be pressed to disengage the release bracket and allow the upper pivot rod 35 to be freely rotated out of the notch 21. The release bracket 40 is biased into the locking position, as shown in FIG. 2, by a torsion spring 44 situated around pivot pin 43 and engaged between the lever arm 41 and the top plate 11. Thus, when the vertical leg 15 is in its extended position, as shown in FIGS. 1 and 2, the torsion spring 21 operates to positively lock the pair of release brackets 40 against the upper pivot rod 35.

Figure 5:
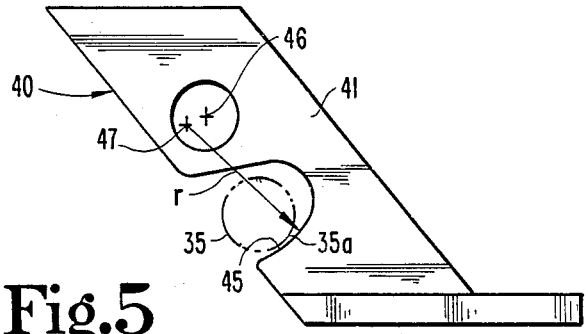
FIG. 5 is an enlarged side view of the release bracket used in the preferred embodiment.

The upper pivot rod 35 reacts against a cam edge 45 on the lever arm 41. A key benefit of the cam edge 45 is described with reference to the detail view of release bracket 40 shown in FIG. 5. The release bracket 40 rotates about the pivot pin axis 46 that extends through pivot pin 43, not shown in this figure. A cam axis 47 is spaced apart from the pivot pin axis 46, as shown in the figure. The cam edge 45 is formed by a constant radius R measured from the axis 47. The upper pivot rod 35, as shown in phantom in FIG. 5, tangentially engages the cam edge 45 at a point 35A that must remain in a fixed relationship with pivot pin axis 46 in order to insure that the vertical leg 15 will remain vertical when the upper pivot rod 35 is engaged between notch 21 and cam edge 45. The primary benefit of cam edge 45 as designed is that it automatically accounts for wear and tolerance variations within the working components of the folding table leg apparatus to maintain a proper engagement point 35A for the upper pivot rod 35. This is accomplished by allowing the engagement point 35A to shift along the cam edge 45 as, for instance, the cam edge wears. The offset location of the cam axis 47 relative to the pivot pin axis 46 insures that the cam edge 45 will continually urge the upper pivot rod 35 into the notch 21, thereby maintaining a vertical orientation for the vertical leg 15.

One benefit of the folding table leg apparatus 10 of the present embodiment is the capability for compactly storing the vertical leg 15 in its retracted position. The brace link 25 that is pivotably mounted to the vertical leg 15 by lower pivot rod 28 is one aspect of the present invention used to accomplish this compact storage. The swivel bracket 50, shown in FIGS. 1 and 2, provides the other element of this compact storage capability. The swivel bracket 50 is pivotably mounted to the side flanges 12 by a blind rivet 51. The swivel bracket 50 is engaged at its other end to the upper pivot rod 35 by way of a buttonhead cap screw 52. the swivel bracket 50 is not intended to act as a load carrying element; however, it is permissible within the scope of the present invention to use the swivel bracket 50 to provide some fore-aft and vertical restraint for the upper pivot rod 35.

Figure 2A:
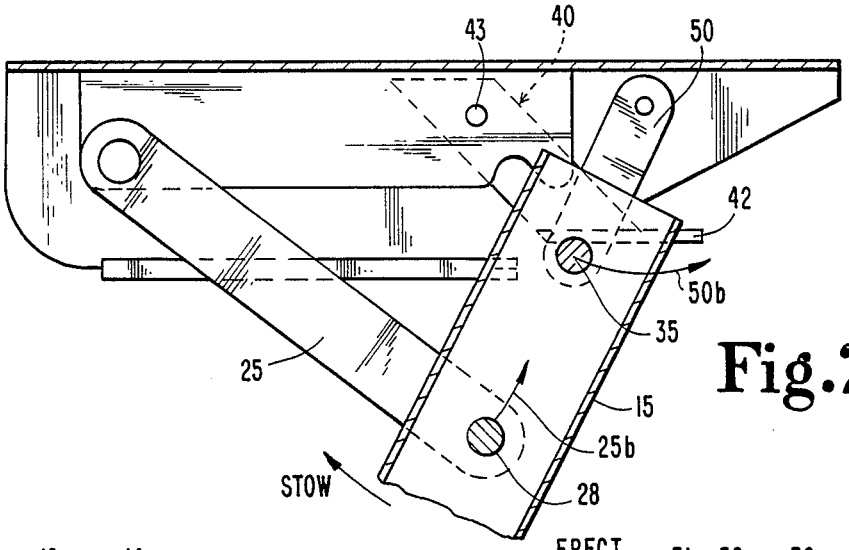
FIG. 2*a* is a cross-sectional view of the apparatus as illustrated in FIG. 2, shown with the table leg at an intermediate position between the extended and folded position.
Figure 3:
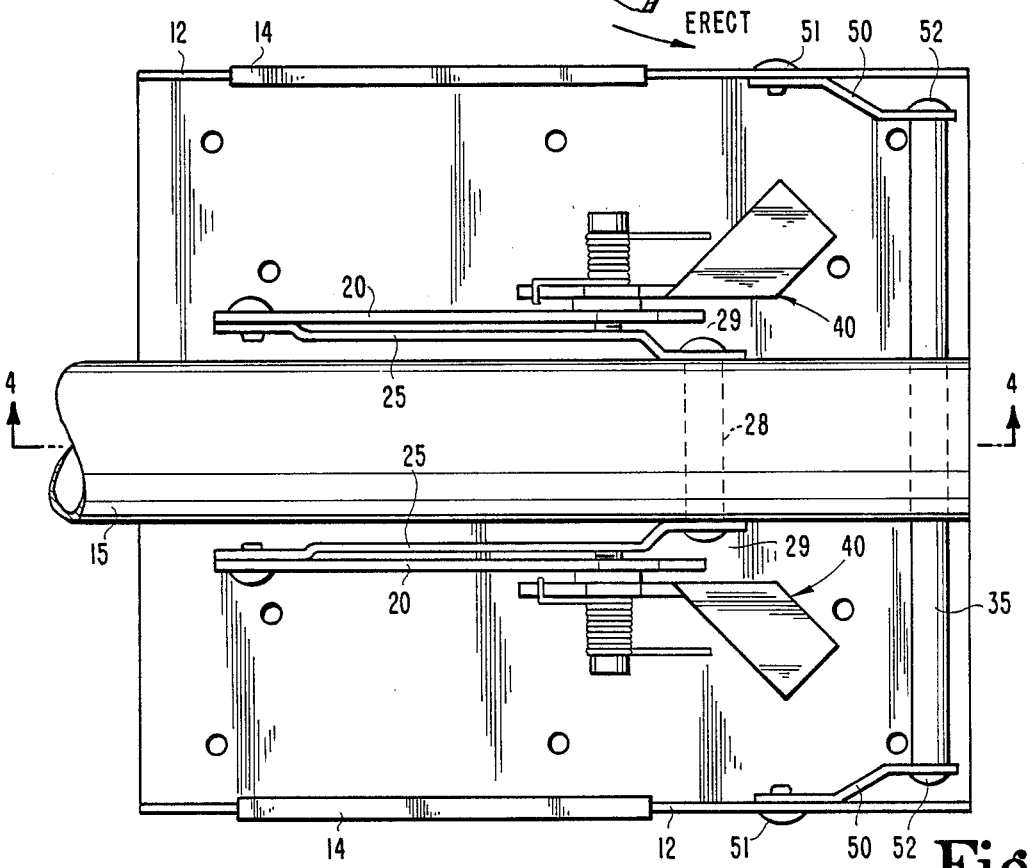
FIG. 3 is a top elevational view of the apparatus shown in FIG. 1, with the table leg in the folded position.
Figure 4:
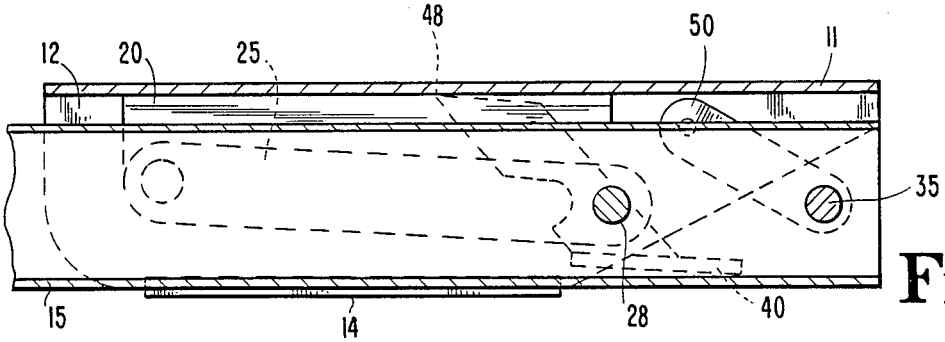
FIG. 4 is a cross-sectional view of the folding table leg apparatus shown in FIG. 3, taken along the line 4—4 as viewed in the direction of the arrows.

When the vertical leg 15 is moved from its extended position, as shown in FIGS. 1 and 2, to its folded or stowed condition, as shown in FIGS. 3 and 4, the brace links 25 and swivel brackets 50 pivot about their pivot points on the support bracket 20 and side flange 12, respectively. The ends of the brace links 25 and swivel brackets 50 that are pivotably engaged with the vertical leg 15 rotate in the paths 25A and 50A, respectively. Thus, unlike the conventional folding table leg that pivots about the top end of the leg toward the interior of the table, the vertical leg 15 of the present invention rotates and translates simultaneously. As the swivel bracket 50 rotates along its path 50A, the top end of the vertical leg 15 translates outward toward the end of the table. The brace link 25 rotates outwardly along path 25A until the vertical leg 15 reaches an intermediate position, illustrated in FIG. 2A. At this point, the top end of the vertical leg at upper pivot rod 35 continues along path 50B of rotation of swivel bracket 50. However, the brace link 25 reverses direction and rotates along path 25B toward the tabletop. Ultimately, the brace link 25 and swivel bracket 50 rotate to the positions shown in FIGS. 3 and 4, in which the vertical leg 15 lies generally parallel to the top plate 11.

A primary benefit of the brace link and swivel bracket construction just described is that, in the folded position, the vertical leg 15 is situated closer to the edge of the tabletop than a typical folding leg would be situated. This mechanical linkage construction is a space saving feature that can be easily adapted for use on smaller tabletops or in instances where a plurality of folding legs are used on a long table. In order to achieve a similar beneficial result, a conventional folding table would require that the vertical leg be hinged at the end of the table and fold inward, an option that severely reduces the flexibility and usability of the folding table.

In the folded position, the outer diameter of the vertical leg 15 lies generally planar with the edges of the side flanges 12. Unlike many folding table leg constructions of the prior art, such as that described in the patent to Johannsen, the folding mechanism of the present invention resides entirely within the side flanges 12. Moreover, unlike other folding leg constructions, such as in the patents to Burr and Holton, the folded table leg itself resides entirely between the tabletop and a plane formed by the edges of the side flanges 12. Rubber extrusions 14 are mounted on the edges of the side flanges 12, forming a separate stacking surface apart from the folded leg 15. The rubber extrusions 14 are composed of a non-marring rubber material so that the tabletop of another folded table can be stacked on the rubber extrusions 14 for storage.

When the table leg 15 is in its stowed position, the release bracket 40 is situated, as shown in FIG. 4, such that the edge of the lever arm 41 is in contact with the top plate at contact point 48. Since the release bracket 40 is spring biased by the torsion spring 44, the point of contact 48 with the top plate 11 is essential to keep the release bracket 40 from rotating beyond the horizontal plane established by the side flanges 12. In addition, the contact point 48 keeps the release bracket 40 in a position that allows the upper pivot rod 35 to pass over the actuator plate 42 when the table leg is to be extended.

Another benefit of the release bracket 40 is illustrated with reference to FIG. 2A. When the vertical leg 15 is moved to its extended position (FIG. 2), the leg 15 is pulled outward away from the top plate 11. At the same time, the brace links 25 and the swivel brackets 50 rotate in opposite directions along the paths 25B and 50B, respectively. That is, the brace links 25 rotate out from the top plate 11, while the swivel brackets 50 rotate into the interior of the table. When the vertical leg 15 has been rotated and translated to a position close to the intermediate position shown in FIG. 2A, the upper pivot rod 35 contacts the actuator plate 42 of the release bracket 40. As the vertical leg 15 is moved further in the counterclockwise direction, the actuator plate 42 acts as a cam surface as the upper pivot rod slides across the plate. The pressure exerted on the actuator plate 42 by the pivot rod 35 causes the release bracket 40 to rotate relative about pivot pin 43, until the vertical leg 15 nearly reaches the extended position. At this point, the upper pivot rod 35 disengages the actuator plate 42, at which time the torsion spring 44 causes the release bracket 40 to pop into its restraining position.

A principal safety feature of the present invention resides in the use of two release brackets 40 situated at either side of the vertical leg 15. In order to fold the vertical leg up from its extended position, it is first necessary to depress the actuator plate 42 on each release bracket 40 to release the upper pivot rod 35 from the notch 21 in support bracket 20. Since the two release brackets 40 are separated by at least the width of the table leg, a conscious effort is required to depress both actuator plates 42 simultaneously in order to release the upper pivot rod 35. This feature virtually eliminates the risk of the vertical leg being accidentally released. Moreover, should one release bracket fail for some reason, another release bracket 40 would be present to keep the vertical leg 15 extended.

The lower pivot rod 28 and the upper pivot rod 35 of the present invention also share a unique advantage over the folding table leg constructions of the prior art. One difficulty associated with previous folding leg constructions is that the support or brace links are mounted at the side of the vertical table leg, so that the leg is typically exposed to unnecessary twisting and lateral movement while the leg is in or being moved to the extended position. Moreover, the support braces of prior art devices are prone to bow as the leg is moved, primarily because the braces are attached by pins or rivets to the outer shell of the table leg.

These problems of the prior art have been overcome in the present invention by, first, providing a pair of brace links 25 and a pair of swivel brackets 50 mounted at diametrically opposite points on the table leg. This provides additional lateral stability and control over twisting or torsion of the vertical leg 15. Another benefit of the side mounted brace links 25 and swivel brackets 50 is that it provides for a more compact folded configuration in which the brace links and swivel brackets rest at the sides of the vertical leg, rather than directly underneath the vertical leg, as is found in the prior art devices.

Figure 6:
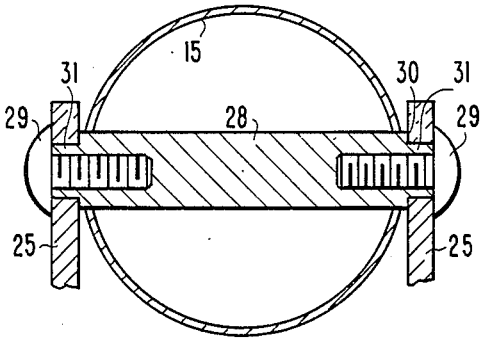
FIG. 6 is an enlarged fragmentary cross-sectional view of a table leg showing pivot rod and the brace links used in the preferred embodiment.

The problems are also addressed by a second feature of the present invention that resides in the design of the pivot rods 28 and 35. The lower pivot rod 28, shown in detail in FIG. 6, extends through the vertical leg 15, passing through the center of the table leg. The lower pivot rod 28 includes a shoulder 30 at each end that projects slightly outside the outer surface of the vertical leg 15. The brace links 25 are situated over end posts 31 that project from shoulders 30. The brace links 25 are retained between the shoulders 30 and the cap screws 29 that are threaded into the ends of the lower pivot rod 28. Thus, the brace links 25 ride on the flat shoulders 30, rather than the curved outer surface of the vertical leg 15. The advantage of this construction is that any lateral flexing of the brace links 25 that might ocur when the legs are in or are moved to the extended position, is restrained by the reaction against the shoulder 30 and the cap screws 29. The same shoulder construction is applied to the upper pivot rod 35 to retain the swivel bracket 50 between a shoulder on the upper pivot rod 35 and the cap screws 52 that mount the swivel bracket to the pivot rod.

The use of pairs of brace links 25 and swivel brackets 50 and pivot rods 28 and 25 also presents another advantage over the prior art folding table leg constructions. In prior art devices, such as those described in the Burr and Holton patents, a single support brace is rotatably affixed to the outer shell of the vertical leg. In the present invention, however, a single pivot rod, such as pivot rods 28 and 35, extends completely through the vertical leg 15, to receive the respective brace links or swivel brackets mounted thereon at the sides of the vertical leg. Thus, unlike the table leg designs of the prior art, twisting forces reacted through the brace links and swivel brackets are passed through the pivot rods, rather than directly into the outer shell of the vertical leg 15. Moreover, the point of reaction for the brace links and swivel brackets on the vertical leg 15 is along a diameter of the leg, passing through the center of the vertical leg 15. Thus, virtually any size and shape of vertical leg can be accommodated by the present folding table leg apparatus 10. Regardless of the leg size and shape, all that is required of the leg is that a pair of bores pass through the leg perpendicular to the longitudinal axis of the leg.

The use of a continuous upper and lower pivot rod further allows the present invention to accommodate vertical legs having a large diameter. In this instance, the folding table leg apparatus 10 can be split into separate left and right halves. The pivot rods 28 and 35, however, are lengthened to provide the connection between the two halves. Similar changes can be made for a split-tee, or tee-tee, type leg that has, essentially, two vertical legs.

Figure 7:
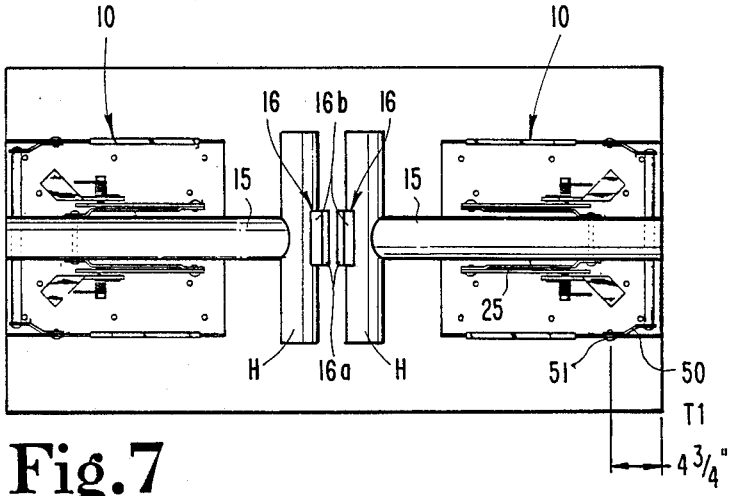
FIG. 7 is a top elevational view of the underside of a table with the folding table leg apparatus of the present invention mounted thereon in one configuration.
Figure 8:
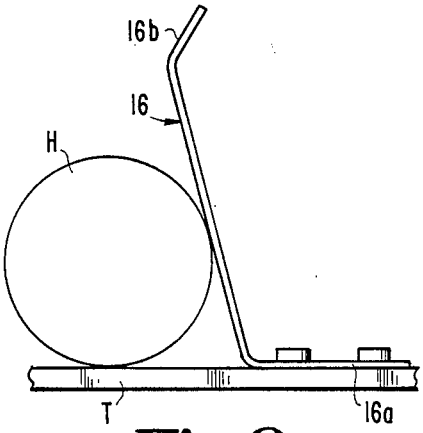
FIG. 8 is an enlarged side detail view of the closing latch illustrated in FIG. 7.

The folding table leg apparatus 10 of the present invention represents an extremely versatile improvement over the prior art devices in that this apparatus is easily adapted to a wide variety of table sizes, constructions and types. The versatility of the folding table leg apparatus 10 of the present invention is demonstrated in FIGS. 7–11. In FIG. 7, a conventional table configuration is illustrated in which a tabletop T1 has a pair of folding table leg apparatus 10 mounted thereon. Each of the legs affixed to tabletop T1 includes the vertical leg 15 affixed to a horizontal leg H in a standard fashion. The folding mechanism formed by brace link 25 and swivel bracket 50 causes the end of the vertical leg 15 to be situated directly adjacent the end of the tabletop T1 when in the stowed condition. A particular advantage of this type of mechanism is demonstrated by the distance between the swivel bracket pivot point, represented by blind rivet 51, and the edge of the tabletop T1. This distance, which is $4\frac{3}{4}$ inches in the preferred embodiment, represents a savings in overall length of the table that is achieved with the present folding table leg apparatus 10 in comparison to a standard single pivot folding table leg. Thus, with the folding table leg apparatus of the present invention, a table approximately eight inches shorter than with a standard hinge can be provided with a folding leg in which the horizontal legs or the vertical legs do not overlap.

When the folding table leg apparatus 10 is in its folded arrangement, as shown in FIG. 7, the horizontal leg H is held in place by a closing latch 16. The closing latch, shown in more detail in FIG. 8, includes a mounting plate 16A that is attached to the bottom of the tabletop T1 in a suitable fashion, and a deflection plate 16B at the free end of the closing latch. When the table leg is moved to its folded position, the horizontal leg H contacts the deflection plate 16B of the closing latch 16 to elastically deform the latch.

Once the horizontal leg H moves past the deflection plate 16B, it is held firmly against the tabletop T1 by the latch.

Figure 9:
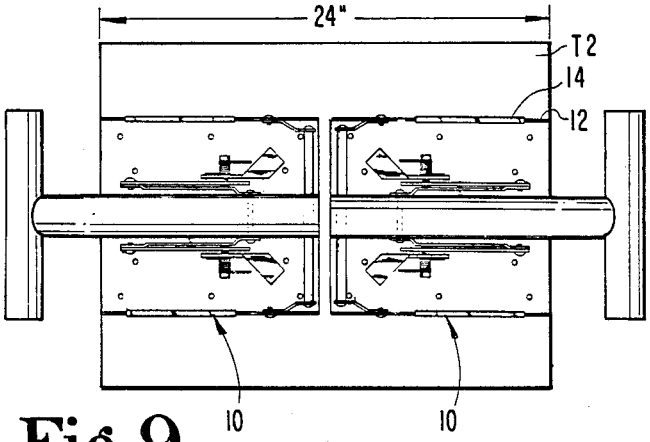
FIG. 9 is a top elevational view of another table with the present apparatus mounted thereon in alternate configuration.

The versatility of the present folding table leg apparatus is illustrated again in FIG. 9, in which a pair of apparatus 10 are mounted directly adjacent, meeting generally in the center of the tabletop T2. It is seen from this example that the compactness of the apparatus 10 allows it to be used alternatively with small length tables. In this instance, the folded legs extend beyond the ends of the tabletop T2. However, the rubber extrusions 14 on the side flanges 12 for both apparatus still provide a flat uniform stacking surface on which other folded tables may be stacked..

Figure 10:
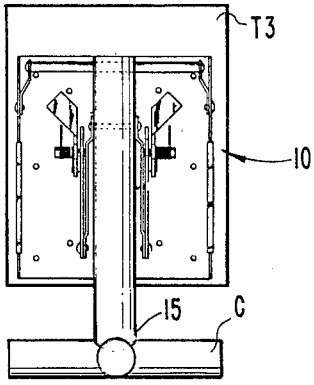
FIG. 10 is a side elevational view of an alternate use of the folding table leg apparatus of the present invention in conjunction with a tilt tabletop article of furniture.

In FIG. 10, the folding table leg apparatus of the present invention is shown used with a tiltable tabletop, as an improvement over the tiltable table described in the patent to Alme, U.S. Pat. No. 3,993,004. In this design, a cross leg C, or X-configured leg, is mounted to the vertical leg 15. The tabletop T3 is affixed to the folding table leg apparatus 10 so that the top can be tilted down while the cross leg C and the vertical leg 15 remain standing upright. In this configuration, the apparatus 10 is not being used to fold a table leg into the table body, but is being used to allow the tabletop itself to be tilted relative to the table leg. One advantage of this application of the apparatus 10 is that the center of gravity of the tilted tabletop is moved considerably lower than with tilting mechanisms, such as those disclosed in the Alme patent. The lowering of the tabletop's center of gravity thereby improves the stability of the table when the tabletop has been tilted.

Figure 11:
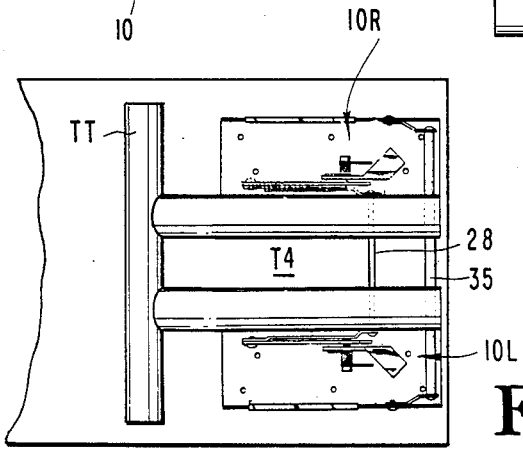
FIG. 11 is a top elevational view of the present apparatus mounted on a tabletop and adapted for use with a split-tee table leg.

The configuration shown in FIG. 11 further demonstrates a flexibility of the present invention, and particularly points out one advantage of the pivot rods 28 and 35. In this version, a tee-tee, or split tee, table leg TT is shown foldably mounted to a tabletop T4. In this version, the folding table leg apparatus is divided into right and left halves 10R and 10L, respectively. Each of these halves are independently mounted to the tabletop T4. However, a single lower pivot rod 28 and a single upper pivot rod 35 are provided that extend between the apparatus sections 10R and 10L. By merely providing a longer pivot rod, the stability and flexibility of the folding table leg apparatus of the present invention is retained. The apparatus described in the patents to Johannsen, Burr or Holton are not easily adapted to accommodate a split tee table leg construction, such as shown in FIG. 11. The versatility demonstrated by the present invention means that a single folding table leg apparatus can now be manufactured to accommodate a wide variety of tabletops and table designs.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A folding table leg apparatus for a folding table having a tabletop and a number of legs operable between a folded and an extended position, said folding table leg apparatus comprising:

a top plate;

means for mounting said top plate to the tabletop;

a pair of side flanges projecting from said top plate, each of said side flanges having a height greater than the effective diameter of said one leg and each having a free edge, said side flanges defining an envelope between said top plate and said free edges; and means, attachable to one each of the number of legs, for folding said one leg from the extended position in which said one leg supports the tabletop to the folded position in which said one leg is folded within said envelope, said folding means being fully contained within said envelope when said one leg is in its folded position, said folding means including;

a pair of brace links straddling said one leg, each of said pair of brace links being pivotably mounted at a first end to said top plate and pivotably connected at a second end to diametrically opposite portions of the leg, such that said brace links provide support for the leg in its extended position;

a pair of swivel brackets straddling the leg, each of said swivel brackets being pivotably mounted at a first end to said side flanges and including means for pivotably connecting said swivel bracket at a second end to diametrically opposite portions of the leg adjacent the top of the leg, said connecting means including a first pivot rod;

a support surface associated with said top plate for vertically supporting said first pivot rod when said one leg is in its extended position; and locking means for releasably engaging and urging said first pivot rod into said support surface when said one leg is in its extended position, said locking means including a pair of independent lever arms straddling the leg and pivotably mounted to said top plate.

2. The folding table leg apparatus of claim 1, wherein: said locking means includes a bias spring associated with each of said pair of lever arms operable to bias said associated lever arm into contact with said first pivot rod when said one leg is in its extended position.

3. The folding table leg apparatus of claim 2, wherein:

each of said pair of lever arms includes a second contact point;

said bias spring is further operable to bias each of said pair of lever arms into contact with said top plate at said second contact point when said one leg is in its folded position; and each of said pair of lever arms includes an actuator plate operable against said bias spring when depressed, said actuator plate including a cam surface oriented so that said first pivot rod contacts said cam surface to depress said actuator plate when said one leg is moved from its folded to its extended position.

4. The folding table leg apparatus of claim 1, wherein:

each of said pair of lever arms includes cam means for urging said first pivot rod into said support surface at a variable point of contact between said cam means and said first pivot rod, said point of contact being variable due to variations in wear or tolerance of said folding table leg apparatus.

5. The folding table leg apparatus of claim 4, wherein:

each of said pair of lever arms is pivotably mounted to said top plate about a first pivot axis; and said cam means includes a cam edge on each of said pair of lever arms, said cam edge being located on a radius measured from a second pivot axis spaced apart from said first pivot axis.

6. The folding leg apparatus of claim 1, wherein:

said first pivot rod is rotatably mounted within a first bore extending through said one leg; and said first pivot rod includes means for attaching each of said pair of swivel brackets at the rod ends, such that said brackets do not bear against said one leg as said first pivot rod rotates.

7. The folding table leg apparatus of claim 1, further comprising:

a second pivot rod rotatably mounted within a second bore extending through said one leg;

said second pivot rod including means for attaching each of said pair of brace links at the rod ends, such that said brace links do not bear against said one leg as said second pivot rod rotates.

8. The folding table leg apparatus of claim 1, further comprising:

a non-marring surface situated along said free edge of each of said pair of side flanges and adapted to have another tabletop stacked thereon when said one leg is in its folded position.

9. A folding table leg apparatus for a folding table having a tabletop and at least one leg of split-tee construction operable between a folded and an extended position, said one leg having a pair of spaced apart vertical leg portions, the folding table leg apparatus comprising:

a pair of top plates, one each of said pair of top plates corresponding to one each of said pair of spaced apart vertical leg portions;

means for mounting each of said pair of top plates to the tabletop;

a side flange projecting from each of said top plates at distal edges of said top plates, said side flange having a height greater than the effective diameter of one of said leg portions and having a free edge, each of said side flanges defining an envelope between said top plate and said free edges;

means, attachable to said one leg, for folding said one leg from the extended position in which said one leg supports the tabletop to the folded position in which said one leg is folded within said envelope, said folding means being fully contained within said envelope when said one leg is in its folded position, said folding means including;

a first pivot rod rotatably mounted within a first bore extending through each of said leg portions adjacent the top of said leg portions;

a second pivot rod rotatably mounted within a second bore extending through each of said leg portions spaced apart from the top of said leg portions;

a swivel bracket associated with each of said leg portions, said swivel bracket being pivotably mounted at a first end to an associated side flange and connected at a second end to an end of said first pivot rod;

a brace link associated with each of said leg portions, said brace link being pivotably mounted at a first end to an associated top plate and connected at a second end to an end of said second pivot rod, such that said brace link provides support for the leg portion when said one leg is in its extended position; and a support surface associated with each of said top plates for vertically supporting said first pivot rod when said one leg is in its extended position.

10. The folding table leg apparatus of claim 9, further comprising:

locking means for releasably engaging and urging said first pivot rod into said support surface associated with each of said top plates when said one leg is in its extended position, said locking means including an independent lever arm associated with each of said leg portions and pivotably mounted to an associated top plate.

11. An article of furniture having a folding tabletop having a center of gravity and operable between an open and a folded position, comprising:

a pedestal leg supporting said tabletop;

a folding apparatus engaged between said tabletop and a top portion of said leg, said folding apparatus including means for orienting said pedestal leg vertically beneath the center of gravity of the tabletop when said tabletop is in its open position, and for orienting the center of gravity of the tabletop lower than said top portion of said leg when the tabletop is in its folded position wherein said folding apparatus includes:

a top plate;

means for mounting said top plate to the tabletop;

a pair of brace links straddling said leg, each of said brace links being pivotably mounted at a first end to said top plate and pivotably connected at a second end to diametrically opposite portions of the leg;

a pair of swivel brackets straddling said leg, each of said swivel brackets being pivotably mounted at a first end to said top plate and including means for pivotably connecting said swivel bracket at a second end to diametrically opposite portions of said leg at said top portion of the leg, said connecting means including a first pivot rod;

a support surface associated with said top plate for vertically supporting said tabletop against said first pivot rod when said tabletop is in its open position;

locking means for releasably engaging and urging said first pivot rod into said support surface when said tabletop is in its open position, said locking means including a pair of independent lever arms straddling said leg and pivotably mounted to said top plate.

12. A folding table comprising:

a tabletop;

a pair of vertical legs;

a pair of folding table leg apparatus, each associated with one of said pair of vertical legs, each of said apparatus including:

a top plate;

means for mounting said top plate to said tabletop;

a pair of side flanges projecting from said top plate, each of said side flanges having a height greater than the effective diameter of said associated leg and each having a free edge, said flanges defining an envelope between said top plate and said free edges;

means for folding said associated leg into a folded position within said envelope, said folding means being fully contained within said envelope when said associated leg is in its folded position, said folding means including;

a pair of brace links straddling said associated leg, each of said brace links being pivotably mounted at a first end to said top plate and pivotably connected at a second end to diametrically opposite portions of the leg, such that said brace links provide support for the leg in its extended position;

a pair of swivel brackets straddling said associated leg, each of said swivel brackets being pivotably mounted at a first end to said side flanges and including means for pivotably connected said swivel bracket at a second end to diametrically opposite portions of the leg adjacent the top of the leg, said connecting means including a first pivot rod; and a support surface associated with said top plate for vertically supporting said first pivot rod when said associated leg is in its extended position;

wherein, said pair of folding table leg apparatus are mounted to said tabletop in a first orientation in which each of said pair of vertical legs is folded toward the middle of said tabletop when the length of the tabletop is greater than the combined length of said pair of vertical legs, and said pair of folding table leg apparatus are mounted to said tabletop in a second orientation in which each of said pair of vertical legs is folded outward from the middle of said tabletop when the length of the tabletop is less than the combined length of said pair of vertical legs.

13. The folding table leg apparatus of claim 12, further comprising:

a non-marring surface situated along said free edge of each of said pair of side flanges and adapted to have another tabletop stacked thereon when said one leg is in its folded position.

* * * * *